US006223397B1

(12) United States Patent
Prevot et al.

(10) Patent No.: US 6,223,397 B1
(45) Date of Patent: May 1, 2001

(54) STACKABLE ERGONOMIC HANDLE

(75) Inventors: Roger M. Prevot, Felton; Crawford Lyons, Spring Grove, both of PA (US); Donald Inman, Trenton, NJ (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 09/503,584

(22) Filed: Feb. 14, 2000

Related U.S. Application Data

(62) Division of application No. 09/212,928, filed on Dec. 17, 1998, now Pat. No. 6,049,945.

(51) Int. Cl.[7] ..... B65D 23/10

(52) U.S. Cl. ..... 16/444; 16/110.1; 16/DIG. 19; 16/430; 215/398; 220/755; 220/756

(58) Field of Search ..... 16/110.1, 114.1, 16/406, 407, 410, 411, 444, DIG. 18, DIG. 19, DIG. 15, DIG. 28; 215/396; 220/741, 759

(56) References Cited

U.S. PATENT DOCUMENTS

| | | |
|---|---|---|
| 2,855,120 | 10/1958 | Bramming . |
| 2,936,478 | 5/1960 | Hegji . |
| 3,016,136 | 1/1962 | Poupitch . |
| 3,021,026 | 2/1962 | Clare . |
| 3,321,798 | 5/1967 | Plamondon . |
| 3,773,249 | 11/1973 | Hidding . |
| 4,091,497 | 5/1978 | Bade . |
| 4,176,423 | 12/1979 | Wigemark . |
| 4,627,546 | 12/1986 | Carranza . |
| 4,841,596 | 6/1989 | Fink . |
| 5,092,476 | 3/1992 | Yasuda et al. . |
| 5,335,954 | 8/1994 | Holub et al. . |
| 5,413,231 | 5/1995 | Carroll et al. . |
| 5,505,330 | 4/1996 | Nunes . |
| 5,535,901 | 7/1996 | Ishii et al. . |
| 5,558,240 | 9/1996 | Karp . |
| 5,605,304 | 2/1997 | Ahern, Jr. . |
| 5,622,579 | 4/1997 | Tobias et al. . |
| 5,704,506 | 1/1998 | Tobias et al. . |
| 5,769,256 | 6/1998 | Medal . |
| 5,918,754 | 7/1999 | Lyons et al. . |

*Primary Examiner*—Anthony Knight
*Assistant Examiner*—Mark Williams
(74) *Attorney, Agent, or Firm*—Howson and Howson

(57) ABSTRACT

A handle which can be permanently attached to a separate blow-molded plastic container. The handle has a contoured portion which comfortably confronts the palm and fingers of a hand of a person lifting the container. The handle is lightweight, injection molded in simple molds, and stackable in a uniform manner so that a stack of the handles can be efficiently stored, transported, and readily machine fed to automated handle-to-bottle attachment equipment. The handle may also be made from recycled plastic for food application.

9 Claims, 7 Drawing Sheets

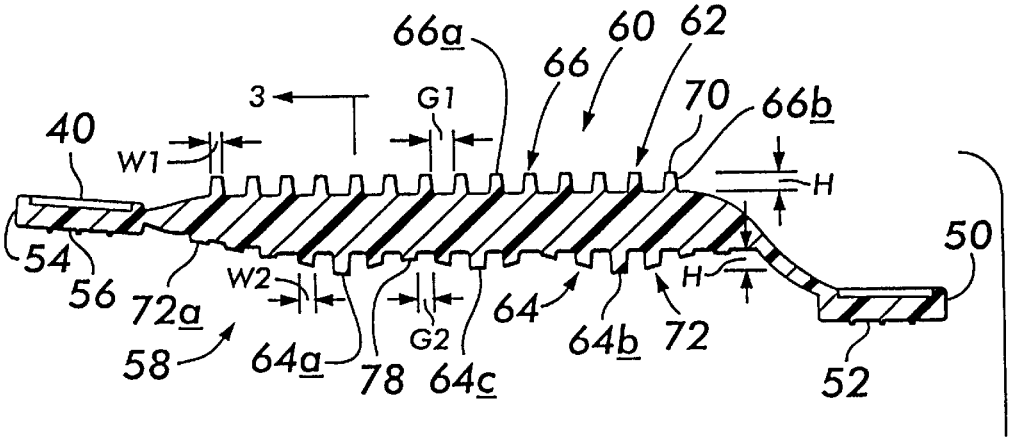
FIG.2
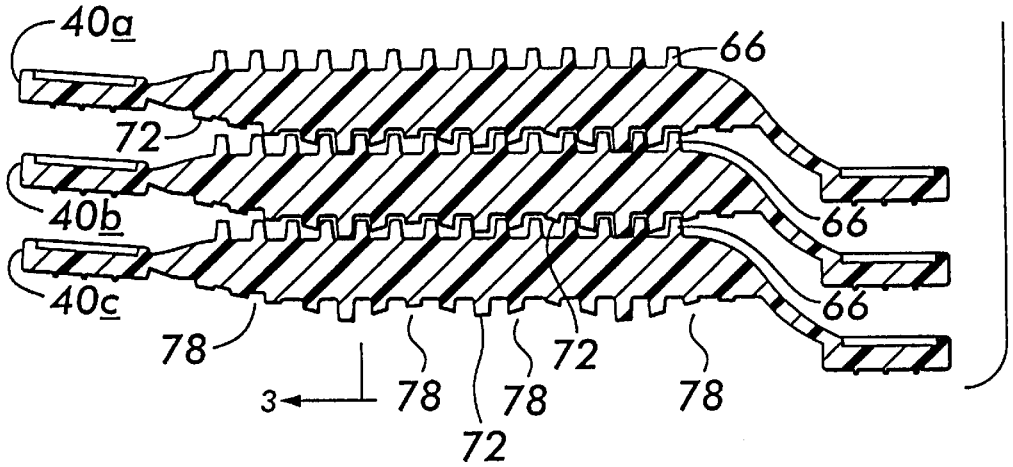

FIG.4
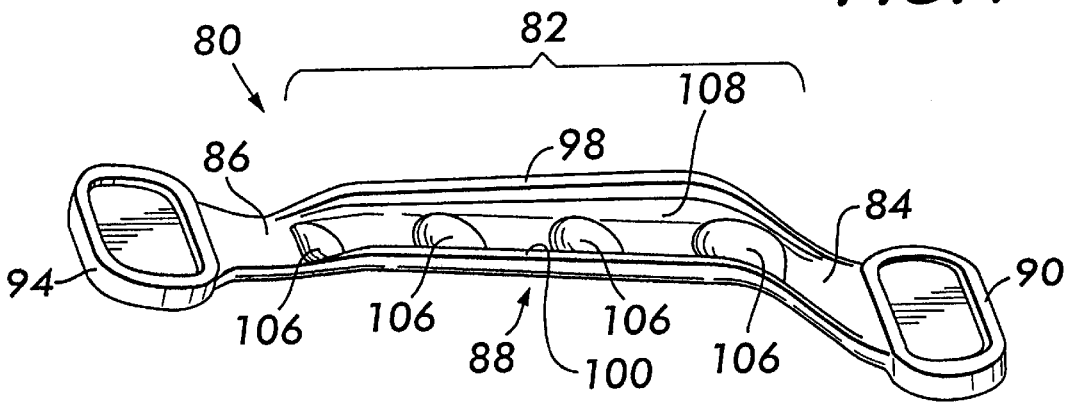
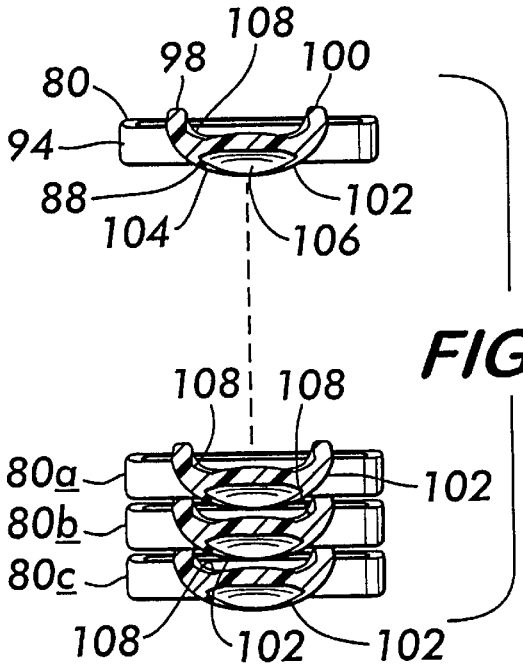
FIG.6

STACKABLE ERGONOMIC HANDLE

CROSS REFERENCE TO RELATED APPLICATION

The present application is a division of application Ser. No. 09/212,928 filed on Dec. 17, 1998, now U.S. Pat. No. 6,049,945.

FIELD OF THE INVENTION

The present invention relates to a plastic handle capable of being permanently attached to a blow-molded plastic container, and more particularly, the present invention relates to a handle which is comfortable to grasp and which is capable of being stacked with like handles so that the handle can be efficiently stored and machine fed through automated handle-to-container attachment systems. The handle may also be made from recycled plastic for applications including food.

BACKGROUND OF THE INVENTION

Blow-molded plastic containers, or bottles, are commonly used for packaging beverages and other liquid, gel, or granular products. Some containers benefit from the use of handles to facilitate a consumer's capability to lift the container and pour its contents. Smaller sized containers, such as 64 ounces and below, generally do not need handles because a consumer can readily grasp the sides of the container to manipulate the container. However, larger containers, such as gallon containers, may require some form of handle in order for a consumer to control the container while lifting or pouring its contents, especially with one hand.

The assignee of the present application has developed several blow-molded containers which are produced by bonding a completely separate, injection-molded plastic handle to a fully molded, plastic container. The containers and methods of manufacture are disclosed in U.S. Pat. No. 5,622,579 issued to Tobias et al.; U.S. Pat. No. 5,704,506 issued to Tobias et al.; pending U.S. patent application No. 08/694,348; pending U.S. patent application No. 08/837,563; and pending U.S. patent application No. 09/049,162. The disclosures of all of the above referenced patents and patent applications are incorporated herein by reference.

The typical handle for being attached to a bottle has an elongate grip portion which is relatively thin in side elevation and which has substantially flat front and rear surfaces which are engaged between the palm and fingers of a person grasping the handle. Relatively uncomplicated configurations for handles have been utilized so that the handles are capable of being readily stacked for storage and stack fed to handle-to-bottle attachment equipment.

Although various known handles may function satisfactorily for their intended purposes, there is a need for a handle which is more comfortable to grasp than a handle having a flat, elongate grip. However, the ergonomic shape of the handle should not prevent the handle from being efficiently stacked and nested within a minimum of space with a plurality of identically configured handles so that the handles can be readily stored and machine fed to handle attachment machinery. In addition, the handles should be lightweight, inexpensive to manufacture, and capable of using recycled plastic for purposes including packaging of food.

OBJECTS OF THE INVENTION

With the foregoing in mind, a primary object of the present invention is to provide a plastic handle which is capable of being permanently affixed to a blow-molded plastic container and which is comfortable to grasp.

Another object of the present invention is to provide an ergonomic handle which is readily machine fed to automated, high-speed handle-to-bottle attachment equipment.

A further object of the present invention is to provide an ergonomic handle which may be efficiently stored to minimize storage space and transportation costs.

A still further object is to provide a lightweight handle which can be injection-molded with a minimum of plastic in a single axis opening injection mold.

A still further object is to provide a lightweight handle which can be injection-molded of recycled plastic and used for purposes including food packaging.

SUMMARY OF THE INVENTION

More specifically, the present invention provides a stackable, ergonomic plastic handle for attachment to a separately manufactured blow-molded plastic container. The handle has an elongate grip with a contoured body section engageable between a palm and fingers of a person grasping the handle. The contoured body section has a palm-confronting side and a finger-confronting side which are designed to be matingly engageable such that when the handle is stacked with an identical handle, the palm-confronting side of one of the handles mates with the finger-confronting side of the other handle to maintain alignment of the handles when stacked.

In one preferred embodiment the contoured body section includes sets of cleats which form palm and finger confronting surfaces. In a second preferred embodiment, the contoured body section is concave between opposed elongate side edges. All embodiments are capable of being stacked with like handles so that the handles can be efficiently machine fed through an automated handle-to-container attachment machinery.

BRIEF DESCRIPTION OF THE DRAWINGS

The foregoing and other objects, features and advantages of the present invention should become apparent from the following description when taken in conjunction with the accompanying drawings, in which:

FIG. 2 is a lengthwise cross-sectional view of the handle illustrated in FIG. 1 stacked with other identical handles;

FIG. 4 is a perspective view of a second embodiment of a handle embodying the present invention;

FIG. 6 is a cross-sectional view of the stacked handles illustrated in FIG. 5 along the line 6—6;

DETAILED DESCRIPTION OF THE PREFERRED EMBODIMENTS

Before turning to the unique aspects of the handle of the present invention, a description of an example of a prior art handle which can be attached to a container is believed to be in order.

Figure 7:
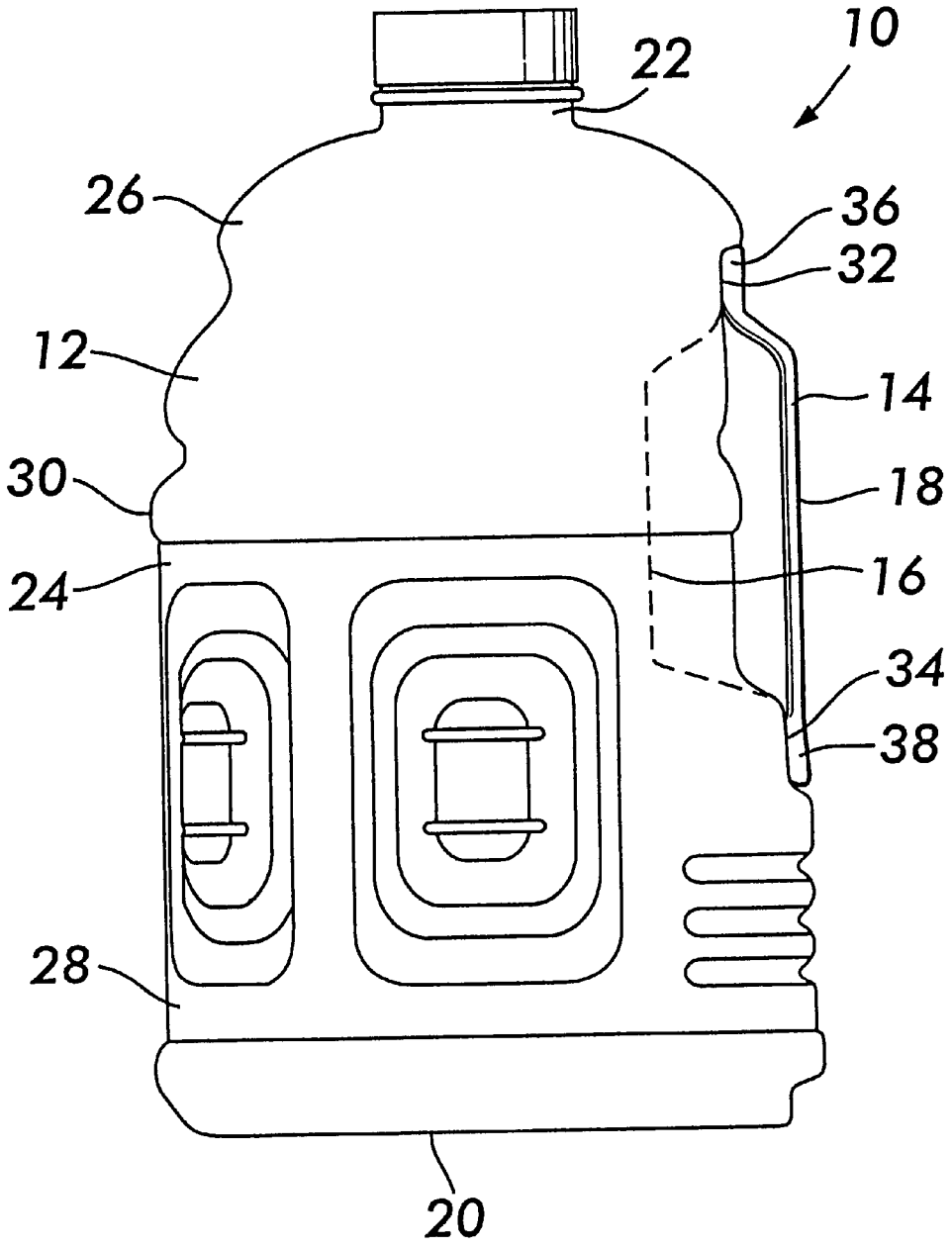
FIG. 7 PRIOR ART
FIG. 7 is a side elevational view of a container having an attached handle with a prior art configuration.
Figure 8:
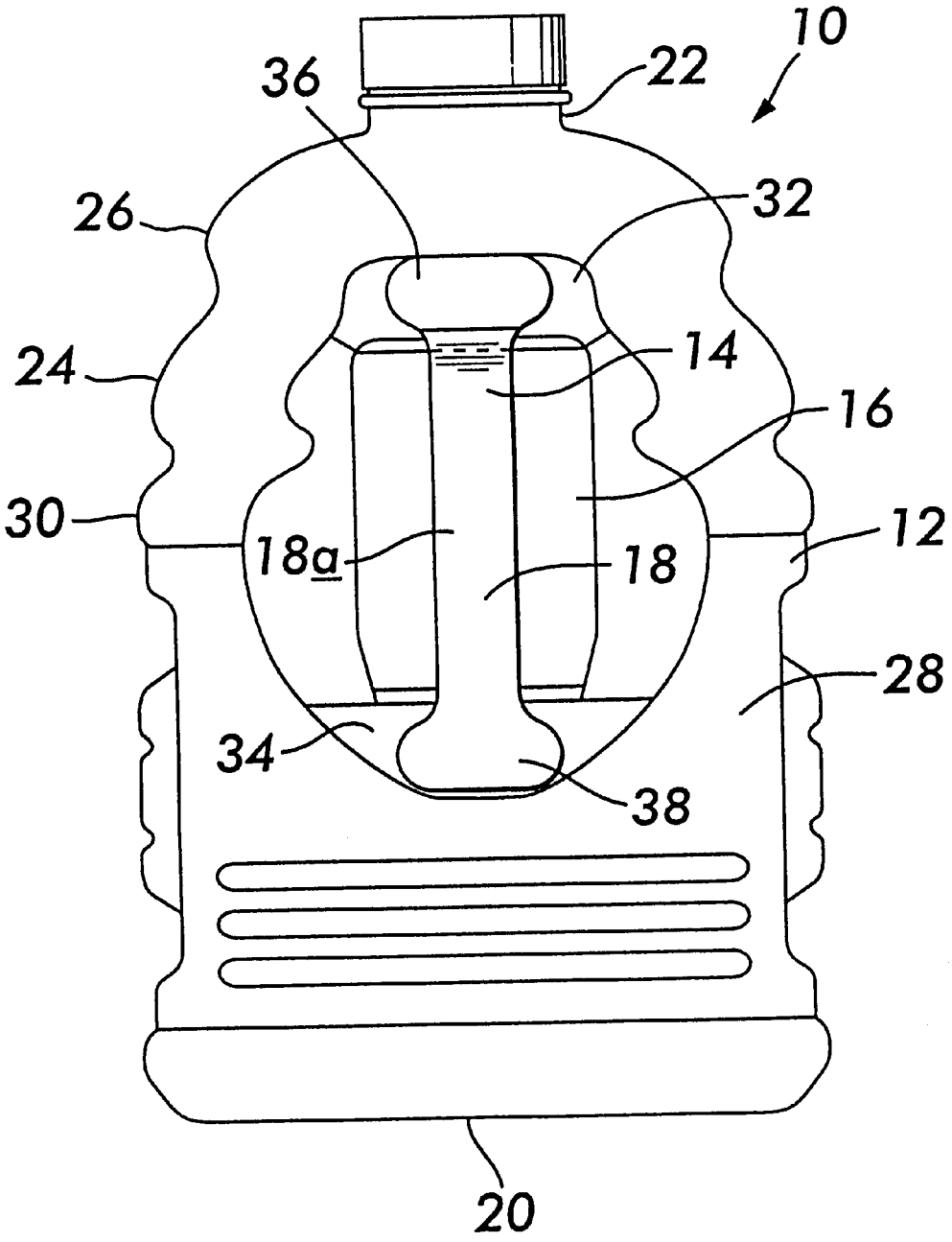
FIG. 8 PRIOR ART
FIG. 8 is an elevational view of the container and prior art handle illustrated in FIG. 7, the container being rotated 90° clockwise about a central vertical axis through the container.

FIGS. 7 and 8 illustrate a container, or bottle, 10 which has a permanently attached handle 14 according to the prior art. The container 10 can be used to package a variety of products, but is particularly useful in packaging liquids, such as juice beverages filled hot. The container 10 can be manufactured in various sizes, but is especially suitable for containing large capacities, such as one gallon, which usually requires two hands to manipulate effectively.

The container 10 has a body portion 12 and a handle 14 which are formed separate from one another. The body portion 12 is preferably produced by conventional blow molding operations, and the handle 14 is preferably produced by conventional injection molding techniques. Both the body portion 12 and the handle 14 are preferably made from the same plastic, such as PET, so that both may be recycled without requiring separation, and thereby enhance the recycle aspects of such a bottle. Furthermore, one may use recycled plastic in the manufacture of such handles, and use such handles for a variety of packaging applications including food.

The body portion 12 has a base 20, a finish 22 and a sidewall 24 extending between the base and finish. The sidewall 24 includes a dome 26 located adjacent to the finish 22 and a lower portion 28 adjacent the base 20. As illustrated, the dome 26 and lower portion 28 are separated by a peripheral rib 30.

The container 10 is preferably manufactured so that it is suited for hot-filling; however, the container 10 is also useful in non-hot-fill applications. If the container is used in hot-fill processes, either the lower portion 28, the dome 26, or both, can have any number or type of vacuum flex panels for accommodating the volumetric changes of the container contents after the container is hot-filled, sealed and cooled.

The container body portion 12 has an inwardly set recess 16 for providing a space for the user's fingers between the body portion 12 and the handle 14. An upper handle mounting surface 32 is formed in the body portion 12 directly above the recess 16, and a lower handle mounting surface 34 is formed in the body portion 12 directly beneath the recess 16. The upper and lower handle mounting surfaces, 32 and 34, are preferably formed planar and substantially vertical but could extend at an angle relative to the vertical. Both are preferably formed so that the handle can be readily bonded, for instance, by welding, gluing or other known techniques, to the container 10.

Figure 9:
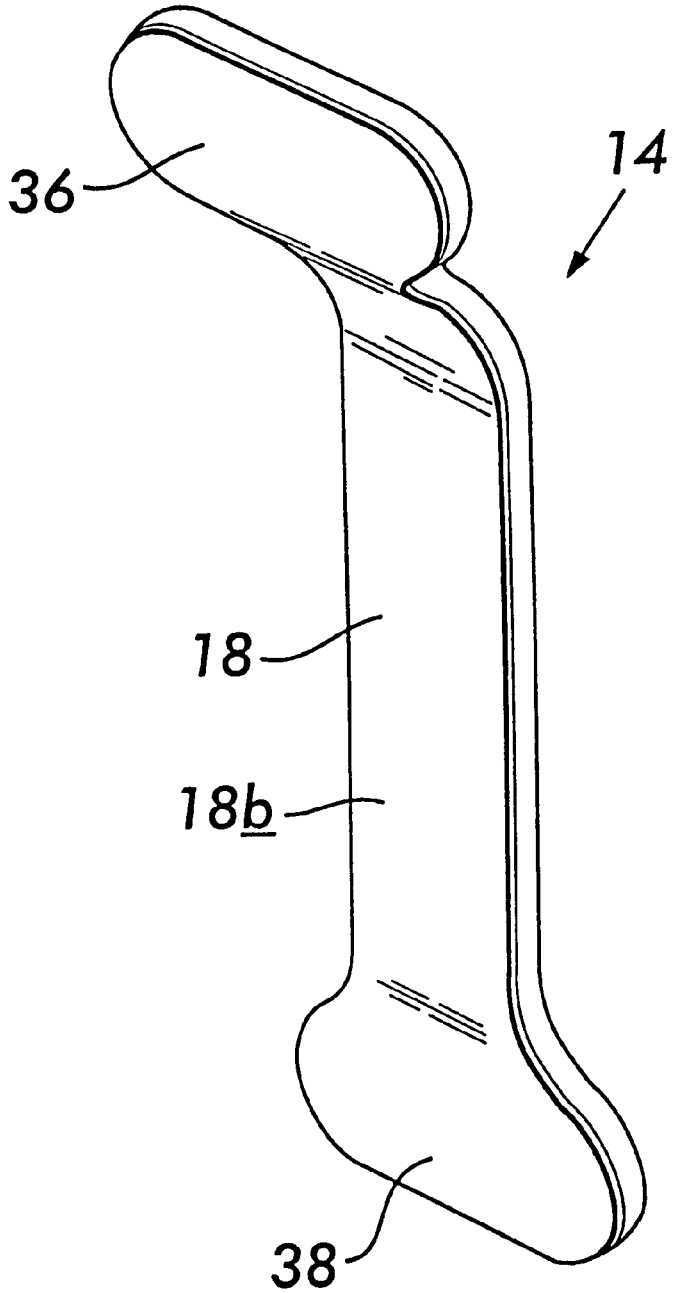
FIG. 9 PRIOR ART
FIG. 9 is a perspective view of a prior art handle.

As illustrated in FIG. 9, the prior art handle 14 is a rigid strap-type handle, which, when attached to the body portion 12, spans across the recess 16 in spaced relation therewith. The handle 14 has a grip portion 18 with substantially flat front and rear side faces, 18*a* and 18*b*, which can be grasped by a consumer. Upper and lower ear attachment tabs, or flanges, 36 and 38, extend from opposite ends of the grip portion 18 and provide handle surfaces which are bonded to the container 10. The upper tab 36 engages and is bonded to the upper handle mounting surface 32, and the lower tab 38 engages and is bonded to the lower handle mounting surface 34.

Turning to the handle of the present invention, and referring to FIGS. 1–6, the handles 40 and 80 are capable of being bonded to a container, such as the container 10, in place of the prior art handle 14. Handles 40 and 80 have an ergonomic configuration which provides comfortable engagement with a person's palm and fingers and which permits nested stacking of like handles so that the handles can be readily stored and machine fed to automated handle-to-container attachment mechanisms. To this end, each handle, 40 and 80, has a palm-confronting side and a finger-confronting side which are matingly engageable such that when each handle is stacked with an identical handle, the palm-confronting side of one of the stacked handles mates with the finger-confronting side of the other stacked handle to maintain alignment of the handles when stacked.

Figure 1:
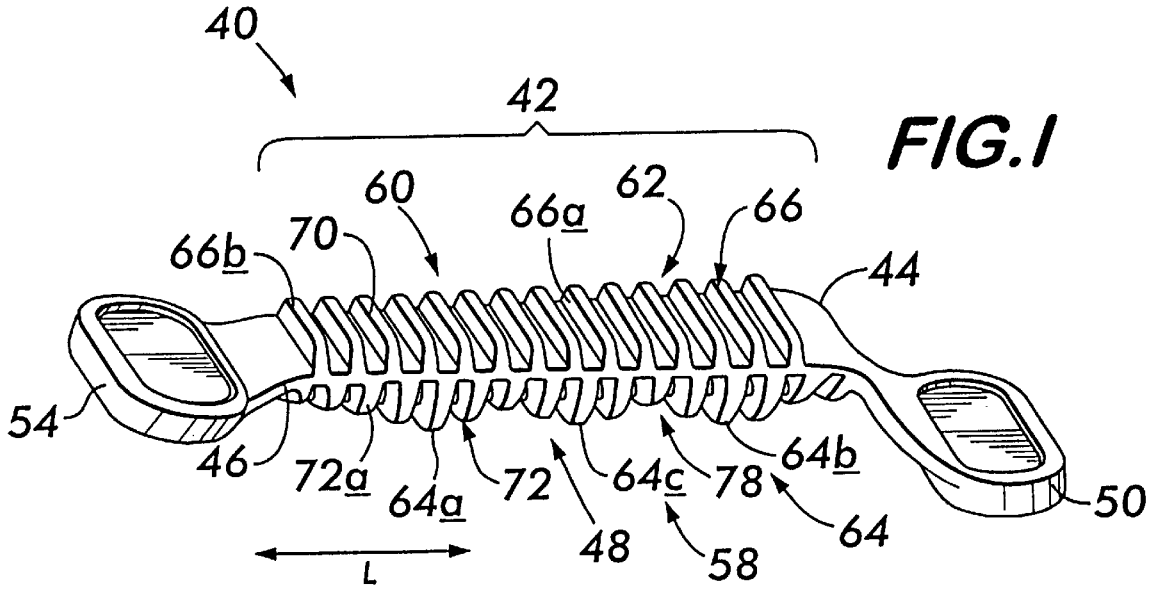
FIG. 1 is a perspective view of a first embodiment of a handle embodying the present invention.

As best seen in FIG. 1, the strap-type handle 40 has an elongate grip 42 with an upper end 44, a lower end 46 and a contoured body portion 48. An upper attachment flange, or tab, 50 extends from the upper end 44 of the grip 42 and has a bonding surface 52 adapted for juxtaposition against a container, and a lower attachment flange, or tab, 54 extends from the lower end 46 of the grip 42 and has a bonding surface 56 adapted for juxtaposition against a container. Preferably, the container has a sidewall with a recess; the upper tab 50 is bonded to the container directly above the recess; and the lower tab 54 is bonded to the container directly beneath the recess so that the grip 42 spans the recess. Alternatively, the handle 40 could be designed to attach within the recess of the container, or to a bottle sidewall not having a recess. In addition, the handle 40 could have alternate shapes, such as a J-shaped strap-type handle, an oval-shaped loop-type handle, or any other handle configuration.

One of the unique aspects of the present invention is the configuration of the contoured body portion 48 of the elongate grip 42. The contoured body portion 48 has a non-planar bottle facing side 58 and an opposite non-planar side 60 which faces radially outward from the bottle. The outward facing side 60 has a surface 62 specifically contoured for comfortably confronting a person's palm and the bottle facing side 58 has a surface 64 specifically contoured for comfortably confronting a person's fingers.

Figure 3:
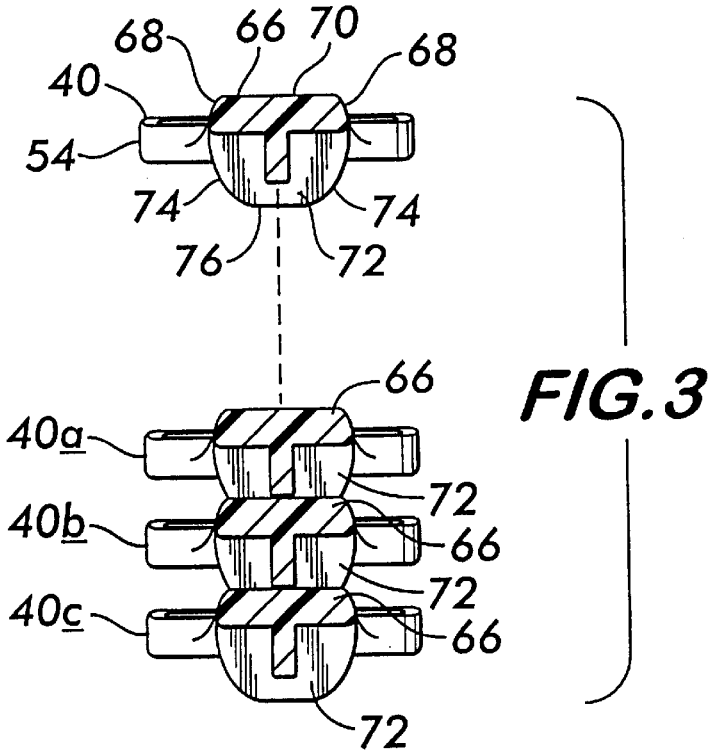
FIG. 3 is a cross-sectional view of the stacked handles illustrated in FIG. 2 along the line 3—3.

Preferably, the palm confronting surface 62 is formed by a first set of spaced-apart cleats 66 extending from the outward facing side 60 of the elongate grip 42. As illustrated in FIGS. 1–3, each cleat 66*a* in the first set of cleats 66 has substantially the same height "H", has rounded side edges 68, has a planar top surface 70, and extends in a straight line perpendicular to the lengthwise direction "L" of the handle 40. However, other cleat sizes and shapes could be utilized, such as V-shaped, curved-shaped, or segmented cleats which extend in a direction transverse to the lengthwise direction "L" of the handle 40. In addition, the height "H" of the cleats 66*a* could vary. For example, the height "H" of the outermost cleats 66*b* could taper downwardly so that the palm confronting surface 62 is tapered between the upper and lower ends, 44 and 46, of the grip 42.

Preferably, the finger confronting surface 64 is formed by a second set of spaced-apart cleats 72 extending from the bottle facing side 58 of the elongate grip 42. As illustrated in FIGS. 1–3, each cleat 72*a* in the second set of cleats 72 has rounded side edges 74, a planar top surface 76, and extends in a direction transverse to the lengthwise direction "L" of the handle 40. The cleats 72*a* vary in height "H" so that a plurality of finger depressions 78 are formed in the bottle facing side 64 of the elongate grip 42. To this end, the finger confronting surface 64 is undulating and preferably has two major peaks, 64*a* and 64*b*, and one shorter centrally positioned peak 64*c*.

The configuration of the first and second set of cleats, 66 and 72, enable a plurality of handles to be stacked in a nested, interlocked condition. As illustrated in FIGS. 2 and 3, handle 40 is capable of being stacked with handles 40*a–c* which are identical in construction to handle 40. The handles are stacked in a uniform single file manner within a minimum of space since the outer perimeter of each handle is directly in line with the outer perimeters of the other stacked handles. The first and second set of cleats, 66 and 72, are offset, or counter positioned with respect to one another, so that the first set of cleats 66 on one handle nests and interlocks with the second set of cleats 72 of another handle. To this end, the gap "G1" between adjacent cleats 66*a* is at least as wide as the width "W2" of the cleat 72*a* opposite therefrom; and the gap "G2" between adjacent cleats 72*a* is at least as wide as the width "W1" of the cleat 66*a* opposite therefrom. As illustrated, both sets of cleats have similar sized cleat widths and gaps; however, the size, shape, and number of cleats and gaps on either, or both, sets of cleats can vary provided the handles can be stacked in a matingly engageable manner.

Turning to the second embodiment of the present invention, the strap-type handle 80 also has an elongate grip 82 with an upper end 84, a lower end 86 and a contoured body portion 88. Likewise, an upper attachment flange, or tab, 90 extends from the upper end 84 of the grip 82 and has a bonding surface 92 adapted for juxtaposition against a container, and a lower attachment flange, or tab, 94 extends from the lower end 86 of the grip 82 and has a bonding surface 96 adapted for juxtaposition against a container. Preferably, the container has a sidewall with a recess; the upper tab 90 is located directly above the recess; and the lower tab 94 is located directly beneath the recess so that the grip 82 spans the recess. Alternatively, the handle 80 could be designed to attach within the recess of the container, or to a bottle sidewall not having a recess. In addition, the handle 80 could have alternate shapes, such as a J-shaped strap-type handle, an oval-shaped loop-type handle, or any other configuration.

The contoured body portion 88 of the handle 80 has a pair of elongate side edges, 98 and 100, extending between the upper and lower ends, 84 and 86, of the elongate grip 82. As best illustrated in FIG. 6, the contoured body portion 88 curves inwardly toward the bottle from one elongate side edge 98 to the other elongate side edge 100; thus, the contoured body portion 88 is concave outwardly relative to the container.

The concave, or arch-shaped, elongate grip 82 provides a sturdier and stronger structure than that of the flat handle structure of handle 14; thus, the handle 80 can be made from less plastic and provide the same structural performance. In addition, during use the curved contoured body portion 88 spreads the bottle's weight over a greater area of the user's fingers and reduces the pressure points on the user's hand. Finally, the curved surface provides a pocket in which the user can place a thumb to enhance bottle control, particularly when pouring.

The non-planar bottle facing side 102 of the contoured body portion 88 provides a curved surface 104 specifically contoured for comfortably confronting a person's fingers. In addition, a plurality of finger depressions 106 are preferably located at appropriate positions on the curved surface 104 to provide it with an undulating shape. The elongate side edges, 98 and 100, form a portion of the outward facing side 108 of the elongate grip 82 which comfortably engage a person's palm. To this end, the side edges, 98 and 100, can be rounded, or formed by elongate bead-like structures, so that they contact a person's palm in a comfortable manner. In addition, the concave outward facing side 108 of the elongate grip 82 can be used as a location for supporting, or providing a backstop to, a thumb, or at least a portion thereof, of the person's hand grasping the handle, thereby providing greater balance during lifting and pouring.

Figure 5:
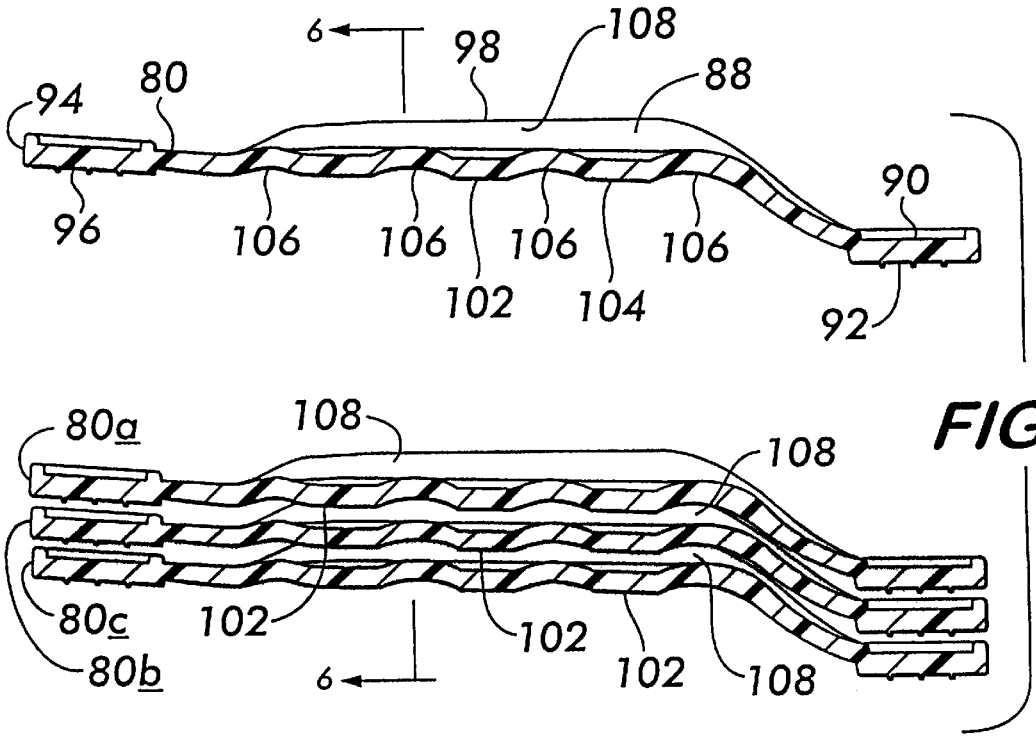
FIG. 5 is a lengthwise cross-sectional view of the handle illustrated in FIG. 4 stacked with other identical handles.

The concave handle configuration enables a plurality of like handles to be stacked in a nested, interlocked condition. As illustrated in FIGS. 5 and 6, the handle 80 is capable of being stacked with handles 80*a–c* which are identical in construction to the handle 80. The outwardly-bowed bottle facing side 102 of one handle extends and nests within the inwardly-bowed non-bottle facing side 108 of an adjacent handle. This permits the handles to be stacked in a uniform single file manner within a minimum of space since the outer perimeter of each handle is directly in line with the outer perimeters of the other stacked handles.

Both of the above-described embodiments of the present invention can be readily injection-molded in uncomplicated molds and at a minimum of cost. Both are relatively lightweight and made from a minimum of plastic to reduce bottle costs and packaging waste. For example, the handle 40 is preferably made from about 20 to 30 grams of plastic, and the handle 80 is preferably made from about 10 to 20 grams of plastic. Each is injection-molded within a simple mold having a single axis opening. The use of complex multiple axis opening molds is not required, hence further reducing cost and improving environmental aspects of the bottle.

Both of the above described handles, 40 and 80, also provide non-slip grippability. For instance, the spaced-apart cleats, 66 and 72, utilized on the handle 40 prevent slippage of a person's palm and fingers, and the finger and thumb depressions 106 and 108 utilized on the handle 80 likewise prevent slippage, thereby increasing safety of bottle use.

The described handles provide a better feel to the person gripping the handles and can be attached to containers utilizing high speed automated equipment because the handles are stackable in a uniform and nested manner. The handles can be efficiently and inexpensively injection-molded from any of several commercially-available plastics, such as PET, provide an aesthetic appearance, reduce storage space, and can withstand the rigors of filling, shipping, lifting and pouring.

While two preferred handles have been described in detail, various modifications, alterations, and changes may be made without departing from the spirit and scope of the present invention as defined in the appended claims.

What is claimed is:

1. A combination plastic handle and blow-molded plastic container, said container having a sidewall and said handle being manufactured separately of said container and being permanently bonded to said container sidewall, said handle comprising an elongate grip having a contoured body section for being engaged between a palm and fingers of a person grasping the handle in a comfortable manner, said contoured body section having a palm-confronting side and a finger-confronting side which are matingly engageable such that when the handle is stacked with an identical handle, said palm-confronting side of one of the handles mates with said finger-confronting side of the other handle to maintain alignment of the handles when stacked, said contoured body section having a pair of elongate side edges and being concave between said elongate side edges so that, when said handle is bonded to said container, said contoured body section bows toward said container.

2. The combination according to claim 1, wherein said elongate side edges are formed by elongate beads.

3. The combination according to claim 1, wherein said concave contoured body section has a plurality of finger depressions.

4. The combination according to claim 1, further comprising a thumb depression adjacent an upper end of said elongate grip.

5. The combination according to claim 1, wherein the handle has a stippled surface to reduce hand slippage.

6. A combination plastic strap-type handle and blow-molded plastic bottle, said bottle being separately manufactured and having a sidewall to which said handle is permanently attached, said handle comprising:

an elongate grip having an upper end, a lower end, an outward facing side, a bottle facing side and a pair of elongate side edges framing said bottle facing side and said outward facing side, a portion of said elongate grip being concave outwardly relative to said bottle such that, when said handle is attached to said bottle, said bottle facing side and said outward facing side of said handle bow toward the bottle;

an upper attachment tab extending from said upper end of said elongate grip and having an attachment surface adapted for juxtaposition against the sidewall of the bottle;

a lower attachment tab extending from said lower end of said elongate grip and having an attachment surface adapted for juxtaposition against the sidewall of the bottle; and the handle being capable of being stacked with like handles; whereby the handle is comfortable to grip and can be efficiently machine fed through an automated handle-to-bottle attachment system.

7. The combination according to claim 6, wherein said elongate side edges are formed by elongate beads.

8. The combination according to claim 7, wherein said elongate grip has a plurality of finger depressions formed in said bottle facing side.

9. A combination injection-molded plastic strap-type handle and blow-molded plastic bottle, said bottle having a sidewall with a recess and being separately manufactured from said handle, said handle being permanently bonded to said bottle sidewall and comprising:

an elongate grip having an upper end, a lower end, an outward facing side and a bottle facing side;

an upper attachment flange extending from said upper end of said elongate grip and having a bonding surface adapted for juxtaposition against the bottle at a location above the recess of the bottle;

a lower attachment flange extending from said lower end of said elongate grip and having a bonding surface adapted for juxtaposition against the bottle at a location below the recess of the bottle such that said elongate grip spans the recess of the bottle;

said elongate grip having a pair of elongate side edges framing said bottle facing side and said outward facing side of said handle;

at least a portion of said elongate grip being concave relative to said bottle such that said bottle facing side and said outward facing side bow toward said bottle; and the handle being capable of being stacked with like handles so that the handle can be efficiently machine fed through an automated handle-to-bottle attachment system.

* * * * *